United States Patent [19]

Pfleger et al.

[11] Patent Number: 4,553,585

[45] Date of Patent: Nov. 19, 1985

[54] COOLING ARRANGEMENT FOR INTERNAL COMBUSTION ENGINES WITH COMBINED SEAWATER-FRESH WATER COOLING

[75] Inventors: Albert Pfleger, Munich; Peter Klesel, Dachau, both of Fed. Rep. of Germany

[73] Assignee: Bayerische Motoren Werke Aktiengesellschaft, Fed. Rep. of Germany

[21] Appl. No.: 435,922

[22] Filed: Oct. 22, 1982

[30] Foreign Application Priority Data

Feb. 1, 1982 [DE] Fed. Rep. of Germany ... 8202493[U]

[51] Int. Cl.[4] ..... F28F 9/00

[52] U.S. Cl. ..... 165/41; 123/41.33; 165/140; 165/145

[58] Field of Search ..... 165/41, 44, 51, 140, 165/145; 123/41.33

[56] References Cited

U.S. PATENT DOCUMENTS

| | | | |
|---|---|---|---|
| 2,013,708 | 9/1935 | Bianchi et al. | 165/41 X |
| 2,390,436 | 12/1945 | Gunter | 165/140 |
| 2,417,237 | 3/1947 | Chandler | 123/41.33 |
| 2,505,790 | 5/1950 | Panthofer | 165/140 |
| 2,656,157 | 10/1953 | Wasielewski | 165/145 X |
| 2,670,933 | 3/1954 | Bay | 165/41 X |
| 3,353,590 | 11/1967 | Holman | 123/41.33 |
| 3,604,502 | 9/1971 | Morse | 165/51 |
| 3,796,547 | 3/1974 | Muenger | 165/140 X |

*Primary Examiner*—William R. Cline
*Assistant Examiner*—Peggy A. Neils
*Attorney, Agent, or Firm*—Craig & Burns

[57] ABSTRACT

A cooling arrangement for a liquid-cooled internal combustion engine with combined seawater-fresh water cooling is disclosed. The arrangement comprises a first heat exchanger for seawater-fresh water exchange and a second heat exchanger for seawater-lubricating-oil heat exchange, and a housing within which the first and second heat exchangers are arranged. The housing includes an inlet duct, a short-circuit duct and a thermostat for fresh water. An additional thermostat and an exchange filter for the lubricating oil are provided adjacent to the first and second heat exchangers.

9 Claims, 5 Drawing Figures

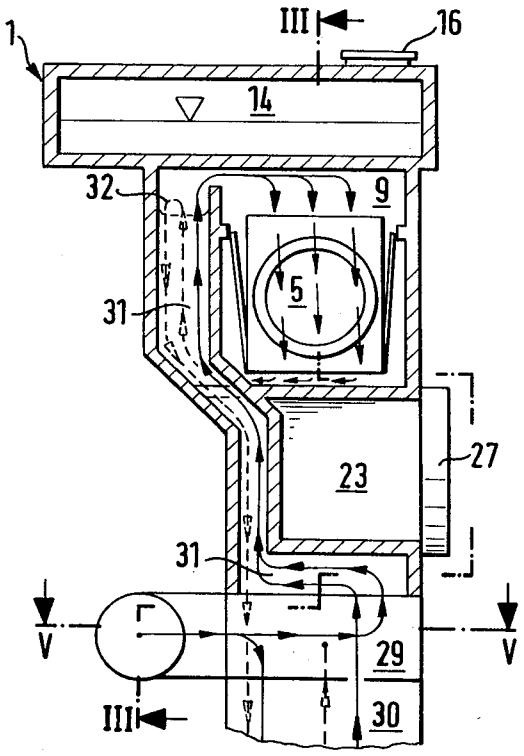
FIG.4
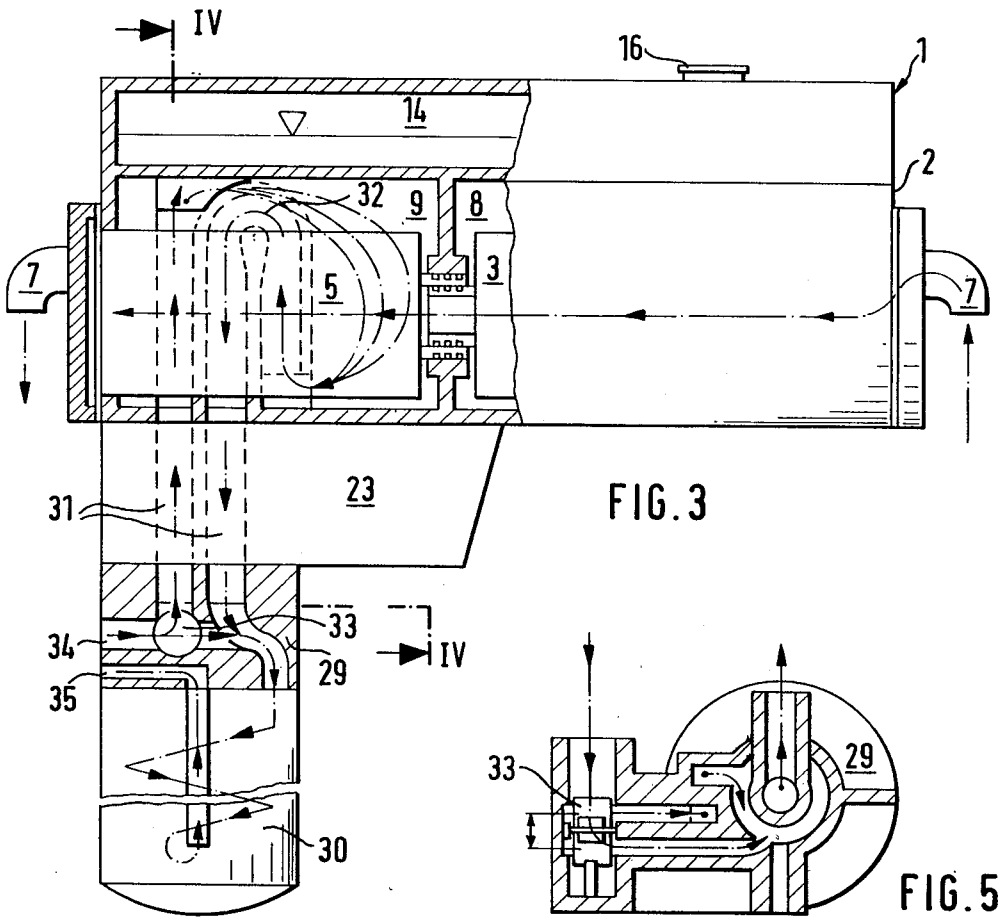
FIG.3
FIG.5

COOLING ARRANGEMENT FOR INTERNAL COMBUSTION ENGINES WITH COMBINED SEAWATER-FRESH WATER COOLING

BACKGROUND OF THE INVENTION

The present invention concerns a cooling arrangement of the type disclosed in U.S. Pat. No. 4,320,798, wherein a heat exchanger that has seawater flowing through it and fresh water flowing around it is installed in a housing as well as a storage tank with a short-circuit duct for fresh water and a thermostat for the temperature control of the fresh water.

An object of the present invention is to further develop the aforementioned known advantageous arrangement in a way that, with the lowest cost of construction, the cooling and the temperature control of the lubricating oil is combined into one individual part of the cooling of the engine coolant consisting of the fresh water.

This and other objects of the invention are obtained by providing a cooling arrangement for a liquid-cooled internal combustion engine with combined seawater-fresh water cooling comprising a first heat exchanger means for seawater-fresh water heat exchange and a second heat exchanger means for seawater-lubricating-oil heat exchange, housing means within which the first and second heat exchanger means are arranged, the housing means including an inlet duct, a short-circuit duct and a thermostat for fresh water, and wherein an additional thermostat and an exchange filter for the lubricating oil are provided adjacent to the first and second heat exchanger means.

In the disclosed, preferred embodiment a storage tank means is also provided within the housing means in fluid communication with the first heat exchanger means. The housing means is a one-piece housing. In this manner, a compact structural unit is obtained in the housing means of which the storage tank means, both heat exchanger means and the thermostat for the fresh water as well as their connections can be developed largely in one piece with the housing means. This reduces exposed connections in regard to number as well as in regard to length and thus content of the seawater, fresh water and lubricating oil which reduces not only the cost of construction but also the weight of the cooling arrangement. Finally, it also reduces the space requirement.

According to a further feature of the present invention, the first and second heat exchanger means are arranged behind one another in the flow direction of the seawater in respective chambers of the housing means. The chambers are arranged opposite one another and separated by a partition having an opening through which the first and second heat exchanger means are connected. Flange means are provided for fastening the thermostat for the fresh water and the first and second heat exchanger means in the housing means and the partition thereof serves as an inside bearing point about the opening therethrough for the first and second heat exchanger means. Further, the first and second heat exchanger means are each formed as slide-in parts with outside mounting flanges and connections and inside cylindrical connecting and support pieces, the latter being arranged and sealed concentrically within one another and in the opening of the partition. This arrangement guarantees that especially the heat exchanger means with sea water flowing through their interiors, which customarily require relatively shortterm maintenance or replacement, can be exchanged with good access and relatively little work. The same is true for the inserts of the thermostats for fresh water and lubricating oil and for the exchange filter for the lubricating oil attached to the one-piece housing.

In the disclosed embodiment of the invention the thermostat for fresh water is arranged in an additional housing chamber of the housing means that is essentially abreast of the second heat exchanger means with ducts for fresh water being provided from the first heat exchanger means and from the short-circuit duct to the thermostat for fresh water in the area of the partition. Lubricating-oil ducts are also provided between the second heat exchanger means and each of the thermostat and the exchange filter for the lubricating oil. The oil ducts are arranged on the outside at the housing chamber of the second heat exchanger means and the additional housing chamber for the thermostat for fresh water. The thermostat and the exchange filter for the lubricating oil are arranged on the outside at the additional housing chamber for the thermostat for fresh water. This makes possible a space-saving arrangement of the ducts and thermostats for fresh water and lubricating oil as well as of the exchange filter for the lubricating oil in the area of the heat exchanger means for lubricating oil. In the area of the heat exchanger means for fresh water, space is therefore saved for other auxiliary aggregates of the engine.

As an additional feature of the invention, at least one of the lubricating-oil ducts leads into the lower area of the housing chamber for the second heat exchanger means and has a course with a high point at the level of the upper area of the housing chamber. This prevents an undesirable emptying of the contents of the lubricating-oil heat exchanger means into the oil pan when the engine is not in operation.

A lubricating-oil filter head and the exchange filter are flanged to the outside of the housing means with the lubricating-oil filter head containing the thermostat for the lubricating oil. This arrangement is advantageous for the maintenance of the engine and the construction of the cooling arrangement. In addition to a thermostat for the lubricating oil, a lubricating-oil filter head also customarily contains control elements for the pressure control of the lubricating-oil circulation so that the resulting control system in the lubricating-oil filter head would have to have an accumulation of material that is disadvantageous for the casting process in the area of the lubricating-oil ducts that have to be mechanically treated. The exchange of the lubricating-oil filter head in the case of operational disturbances and of the exchange filter as the customary maintenance process benefits from this development.

The storage tank means is connected with the inlet duct, the short-circuit duct and the housing chamber for the first heat exchanger means by a narrow venting and volume-balancing opening. The storage tank means also has inlet and outlet openings for connection with a venting connection and with the suction-pressure area of the cooling circulation of the engine, respectively. Further, the inlet duct, short-circuit duct and the housing chamber of the first heat exchanger means have a direct connection for a connecting line to the outlet of a cooling jacket of the engine, and the additional housing chamber of the thermostat has a connection for a connecting line to the suction area of the cooling circulation of the engine. This results in an inside structure and a connection of the cooling arrangement to the cooling system of the engine that largely ventilates the engine as well as the circulating content of the cooling arrangement.

These and other objects, features and advantages of the present invention will become more apparent from the following description when taken in connection with the accompanying drawings which show, for purposes of illustration only, one embodiment in accordance with the present invention.

BRIEF DESCRIPTION OF THE DRAWINGS

FIG. 3 is a partial longitudinal section corresponding to FIG. 1 showing the course of the seawater and the lubricating-oil flow;

FIG. 4 is a sectional view taken along line IV—IV in FIG. 3; and

FIG. 5 is a sectional view taken along line V—V in FIG. 4.

DETAILED DESCRIPTION OF THE DISCLOSED EMBODIMENT

Figure 2:
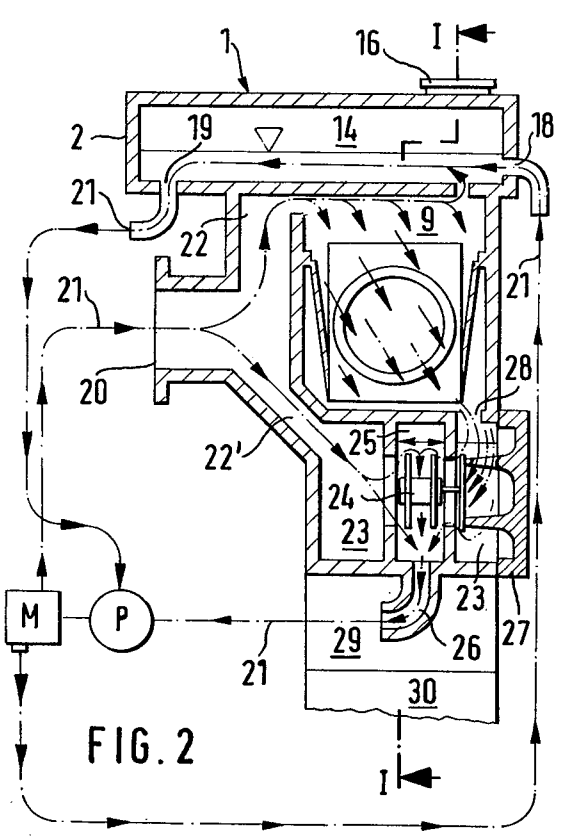
FIG. 2 shows a cross-section taken along line II—II in FIG. 1 and illustrating the course of the fresh water flow.
Figure 1:
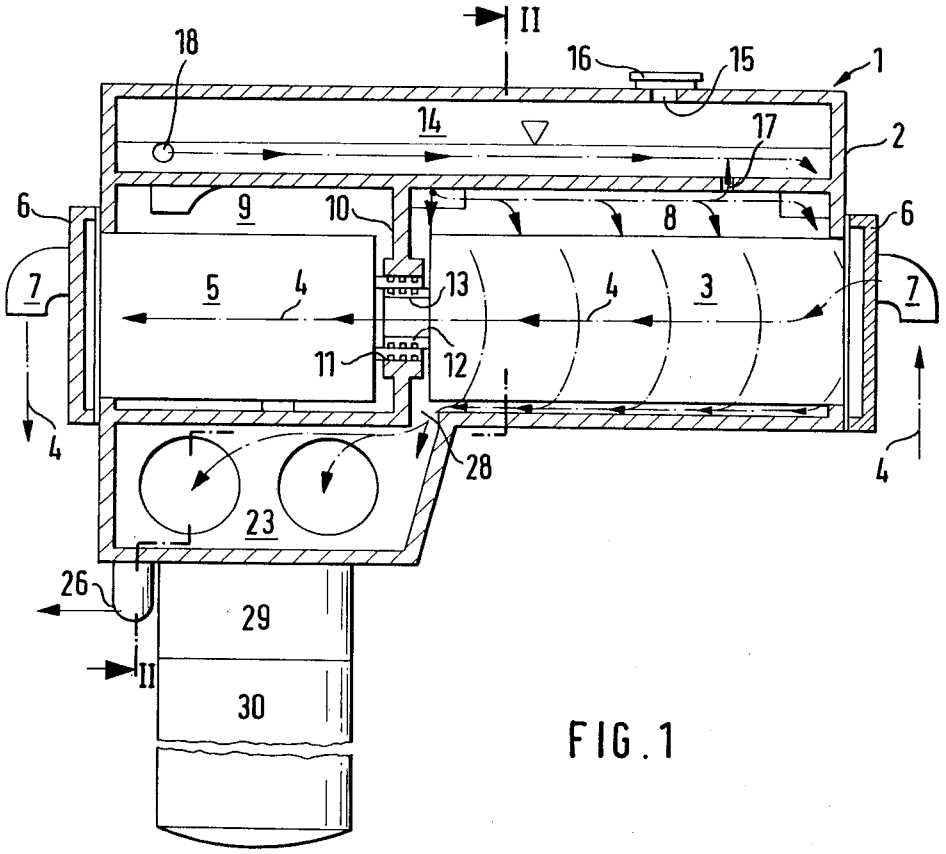
FIG. 1 shows a cooling arrangement according to the present invention for boat engines in longitudinal section with the course of the seawater and fresh water flow.

Referring now to the drawings, there is illustrated a cooling arrangement 1 according to the invention for an internal-combustion engine, not shown, for the installation into a water craft. The cooling arrangement comprises, for combined fresh water-seawater cooling, in a housing 2 that is essentially in one piece, a heat exchanger 3 for the fresh water that acts as the engine coolant and is mixed with an anti-freeze and/or anti-corrosion agent, and for the sea water that acts as the heat conductor and that can also be exchanged by other natural water, such as tap water, river water or ocean water according to the use of the internal-combustion engine. In flow direction 4 of the seawater, another heat exchanger 5 is connected to the outlet side of the heat exchanger. The heat exchanger 5 is used for the cooling of the lubricating oil of the engine and, like the heat exchanger 3, has seawater flowing through its interior according to the flow direction 4. Apart from their total length, the heat exchangers 3 and 5 have largely the same structure. The installation of the heat exchangers 3 and 5 into the housing 2 takes place by means of mounting flanges 6, 6 and by mounting means, not shown. The mounting flanges 6,6 each have a connection 7 for the supply and the drainage of the seawater.

Chambers or housing spaces 8 and 9 are molded into the housing 2 to accommodate the respective heat exchangers 3 and 5. Fresh water flows through the chamber 8 and lubricating oil flows through the chamber 9. The chambers 8 and 9 are separated from one another in a leak-proof manner by a partition 10. The partition 10 has a cylindrical opening 11 within which the cylindrical connection and support pieces 12 and 13 of the heat exchangers 3 and 5 are located and sealed off with the pieces 12 and 13 in concentric, telescoped relation. Together with the mounting flanges 6,6, the connections 7,7 and the connection and support pieces 12 and 13, the heat exchangers 3 and 5 form respective structural units which are each developed as a slide-in part.

Above the chambers 8 and 9, the housing 2 has a storage tank 14 formed therein which is essentially closed on all sides and serves at the same time as an expansion and ventilation chamber. A filler opening 15 with a lid 16 is provided on the top side of storage tank 14 for filling the cooling arrangement and the whole cooling system of the internal combustion engine. The lid 16 contains in the usual manner, an excess-pressure relief valve limiting the maximum pressure in the cooling system and a ventilating valve for avoiding low pressure. A narrow ventilation bore hole 17 connects chamber 8, at a high point, with the interior of the storage tank 14 for ventilation of fresh water from the chamber 8 and thus from the whole cooling system of the internal-combustion engine. In addition, the storage tank 14 has an inlet opening 18 for connection with a venting connection and an outlet opening 19 for connection with the suction-pressure area of the cooling circulation of the engine.

For the main flow of the fresh water through the cooling arrangement 1 and through the heat exchanger 3, a direct connection 20 is provided at the housing 2 to the outlet of the cooling jacket of the engine. In flow direction 21 of the fresh water, the connections, which for the fresh water are shaped in one piece in the housing 2, branch into a feeding duct 22 and into a short-circuit duct 22', where the former (22), by means of the heat exchanger 3, and the latter (22') lead directly into an additional chamber 23 of the housing for a thermostat 24 for temperature control of the fresh water. From the mixing chamber 25 of the thermostat 24, a connection 26 leads to the suction side of the coolant pump of the engine. The housing chamber 23 for the thermostat 24 is also developed as a recess in the one-piece housing 2. Thermostat 24 is inserted and held in chamber 23 by means of a flange 27, and mounting elements that are not shown.

Between the chamber 8 containing the heat exchanger 3 and the housing chamber 23 containing the thermostat 24, a connection opening 28 is provided for the passage of the fresh water. Therefore, in the area of the heat exchanger 3 outside the housing 2, there is enough space for the arrangement of other components and auxiliary aggregates of the engine. For the same purpose, a lubricating-oil filter head 29 and an adjoining exchange filter 30 for the lubricating oil, below filter head 29, are flanged to the housing 2 at the bottom side of the housing chamber 23. In order to connect the lubricating-oil system of the engine, by means of the lubricating-oil filter head 29, with the heat exchanger 5 for the lubricating oil, lubricating-oil ducts 31 are shaped to the housing 2 at its bottom and rear sides. The lubricating-oil duct 31 that leads into the lower area of the housing chamber 9, in its course, has a highest position 32 that prevents an emptying of the housing chamber 9 when the engine is not in operation. As shown in FIGS. 3 and 5, a thermostat 33 is installed in a lubricating-oil filter head 29, for the temperature control of the lubricating-oil and thus for the control of the quantity of lubricating-oil flowing through the heat exchanger 5. The lubricating-oil head 29 and the exchange filter 30 also have ordinary pressure-control valves that are not shown as well as connections 34 and 35 for the forward and return-flow to and from the lubricating system of the engine.

A cooling arrangement according to the disclosed embodiment of the invention contains a compact combination of the auxiliary aggregates required for the cooling and lubrication of an internal combustion engine with combined seawater-fresh water and seawater-lubricating-oil cooling, including the lubricating-oil pressure control and the lubricating-oil filtering. Here the combination of these aggregates in addition results in a weight decrease and a lesser number of connections and their mountings. The latter also reduces the number of possible leaks in the cooling and lubricating system. The structure of the cooling arrangement and the arrangement of the lubricating-oil filter head and of the exchange filter also results in a good access with respect to maintenance and consequently in short maintenance times.

While we have shown and described a single embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A cooling arrangement for a liquid-cooled internal combustion engine with combined seawater-fresh water cooling, comprising a first heat exchanger means for seawater-fresh water heat exchange and a second heat exchanger means for seawater-lubricating oil heat exchange, one-piece housing means within which said first and second heat exchanger means are arranged to define a fresh water chamber about said first heat exchanger means and a lubricating oil chamber about said second heat exchanger means, wherein said first and second heat exchanger means are arranged behind one another in the flow direction of the seawater in said respective chambers of the one-piece housing means, said chambers being arranged opposite one another and separated by a partition having an opening through which said first and second heat exchanger means are connected, said one-piece housing means including an inlet duct for receiving seawater, an outlet duct for discharging seawater, a short-circuit duct in fluid communication with said fresh water chamber, and a fresh water thermostat for sensing temperature of fresh water in said short-circuit duct, wherein an additional thermostat and a lubricant exchange filter for filtering oil are fluidly connected to each other and said lubricating oil chamber and disposed adjacent to one of said first and second heat exchanger means to permit said lubricating oil to bypass said seawater-lubricating oil heat exchanger means, and wherein the fresh water thermostat is arranged in an additional housing chamber of said one-piece housing means that is essentially abreast of said second heat exchanger means with ducts for fresh water being provided from said first heat exchanger means and from said short-circuit duct to the fresh water thermostat in the area of said partition to permit said fresh water thermostat to bypass fresh water around said seawater-fresh water heat exchanger means.

2. A cooling arrangement according to claim 1, wherein lubricating oil ducts are provided between the second heat exchanger means and each of the thermostat and the exchanger filter for the lubricating oil, said lubricating oil ducts being arranged on the outside at the housing chamber of the second heat exchanger means and the additional housing chamber for the thermostat for fresh water, and wherein the thermostat and the exchange filter for the lubricating oil are arranged on the outside at the additional housing chamber for the thermostat for fresh water.

3. A cooling arrangement according to claim 2, wherein at least one of said lubricating oil ducts leads into the lower area of the housing chamber for the second heat exchanger means and has a course with a highest point at the level of the upper area of the housing chamber.

4. A cooling arrangement for a liquid-cooled internal combustion engine with combined seawater-fresh water cooling, comprising a first heat exchanger means for seawater-fresh water heat exchange and a second heat exchanger means for seawater-lubricating oil heat exchange, one-piece housing means within which said first and second heat exchanger means are arranged, wherein said first and second heat exchanger means are arranged behind one another in the flow direction of the seawater in respective chambers of the one-piece housing means, said chambers being arranged opposite one another and separated by a partition having an opening through which said first and second heat exchanger means are connected, said one-piece housing means including an inlet duct, a short-circuit duct and a thermostat for fresh water, wherein an additional thermostat and an exchange filter for the lubricating oil are fluidly connected to each other and to said seawater-lubricating oil heat exchanger, provided adjacent to said first and second heat exchanger means to permit the lubricating oil to bypass said seawater-lubricating heat exchanger means, and a storage tank means connected with the inlet duct, the short-circuit duct and the housing chamber for the first heat exchanger means by a narrow venting and volume-balancing opening, the storage tank means having inlet and outlet openings for connection with said venting opening connection and with an inlet and outlet area of the cooling circulation system of the engine, respectively, and wherein said fresh water thermostat is located adjacent to a main portion of said housing means and bypasses fresh water around said seawater-fresh water heat exchanger means from said chamber via said short-circuit duct and said fresh water thermostat to the inlet area of said cooling circulation system of the engine.

5. A cooling arrangement according to claim 4, wherein the thermostat for fresh water is arranged in an additional housing chamber of said one-piece housing means, and wherein the inlet duct, short-circuit duct and the housing chamber of the first heat exchanger means have a direction connection for a connecting line to the outlet of a cooling jacket of the engine, and the additional housing chamber of the thermostat has a connection for a connecting line to the suction area of the cooling circulation of the engine.

6. A cooling arrangement according to claim 2, wherein a lubricating-oil filter head and the exchanger filter are flanged to the outside of said housing means, said lubricating-oil filter head containing the thermostat for the lubricating oil.

7. A cooling system for a liquid-cooled internal combustion engine having both seawater and fresh water cooling, said cooling system comprising:

seawater-fresh water heat exchanger means for exchanging heat between seawater and fresh water;

seawater-lubricating oil heat exchanger means for exchanging heat between seawater and lubricating oil;

one-piece housing means for supporting in tandem said heat exchanger means so as to permit serial passage of seawater therethrough and for defining respective fresh water and lubricating oil chambers about said seawater-fresh water and seawater-lubricating oil heat exchanger means, said housing means further including inlet and outlet ducts for respectively receiving and discharging seawater, and a short-circuit duct for enabling passage of a portion of fresh water from said fresh water chamber;

fresh water thermostat means disposed in said short-circuit duct for sensing temperature of the fresh water and bypassing fresh water around said seawater-fresh water exchanger means, and a lubricating oil filter unit disposed adjacent to one of said heat exchanger means, said unit including oil filter means for filtering oil, means for passing oil through said filter means, and lubricating oil thermostat means fluidly connected to said oil filter means for sensing temperature of said oil and bypassing oil around said seawater-lubricating oil heat exchanger means.

8. A cooling system as recited in claim 7, wherein said housing means includes flange means for fastening at least one of said fresh water thermostat means, lubricating oil thermostat means, and said heat exchanger means, said housing means further including a partition for dividing and separating said fresh water and lubricating oil chambers and for providing a bearing against which said heat exchangers engage for supporting openings therein against said housing means.

9. A cooling system as recited in claim 8, wherein said heat exchanger means are formed as slide-in parts with outside mounting flanges and connections, and inside cylindrical connecting and support pieces which are arranged and sealed concentrically within one another and in said opening of said partition.

* * * * *